US008876537B2

(12) United States Patent
Katsuse

(10) Patent No.: US 8,876,537 B2
(45) Date of Patent: Nov. 4, 2014

(54) ELECTRICAL JUNCTION BOX

(71) Applicant: Sumitomo Wiring Systems, Ltd., Yokkaichi (JP)

(72) Inventor: Shunsuke Katsuse, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 26 days.

(21) Appl. No.: 13/767,136

(22) Filed: Feb. 14, 2013

(65) Prior Publication Data

US 2013/0237069 A1 Sep. 12, 2013

(30) Foreign Application Priority Data

Mar. 9, 2012 (JP) ..... 2012-052955

(51) Int. Cl.

| | |
|---|---|
| ***H01R 12/00*** | (2006.01) |
| ***H01R 13/73*** | (2006.01) |
| ***H01R 9/22*** | (2006.01) |
| ***H01R 13/506*** | (2006.01) |
| *H01R 13/627* | (2006.01) |
| *H01R 13/514* | (2006.01) |

(52) U.S. Cl.

CPC ..... *H01R 9/223* (2013.01); *H01R 13/73* (2013.01); *H01R 2201/26* (2013.01); *H01R 13/6273* (2013.01); *H01R 13/514* (2013.01); *H01R 13/506* (2013.01)

USPC ..... 439/76.2; 439/701

(58) Field of Classification Search

USPC ..... 439/76.2, 701

See application file for complete search history.

(56) References Cited

U.S. PATENT DOCUMENTS

| | | | | |
|---|---|---|---|---|
| 5,941,716 | A * | 8/1999 | Yoshigi | 439/95 |
| 7,500,856 | B2 * | 3/2009 | Iizuka | 439/76.2 |
| 7,594,830 | B2 | 9/2009 | Murakami et al. | |
| 7,717,720 | B2 * | 5/2010 | Ikeda | 439/76.2 |
| 7,727,022 | B2 * | 6/2010 | Polehonki et al. | 439/620.27 |
| 8,163,994 | B2 * | 4/2012 | Taniguchi et al. | 174/50 |
| 2003/0109150 | A1 * | 6/2003 | Saka et al. | 439/76.2 |
| 2008/0293269 | A1 * | 11/2008 | Kurizono et al. | 439/76.2 |
| 2013/0237068 | A1 * | 9/2013 | Katsuse | 439/76.2 |

* cited by examiner

*Primary Examiner* — Gary Paumen

(74) *Attorney, Agent, or Firm* — Gerald E. Hespos; Michael J. Porco; Matthew T. Hespos

(57) ABSTRACT

An electrical junction box (10) has a box body (84) is formed by combining a first case (12) and a second case (14). The first case (12) is provided with a receptacle (18) that houses a connector (20). The second case (14) has a connector lock (50) that fixes the connector (20) in the receptacle (18) and a vehicle fixing portion (68) that fixes the box body (84) to a vehicle attachment portion (78).

10 Claims, 10 Drawing Sheets

ELECTRICAL JUNCTION BOX

BACKGROUND OF THE INVENTION

1. Field of the Invention

The invention relates to an electrical junction box for an automobile or the like, and in particular relates to an electrical junction box in which a connector lock for fixing a connector and a vehicle fixing portion for fixation to a vehicle.

2. Description of the Related Art

Electrical junction boxes have been used in automobiles and the like to facilitate the branching of wiring harnesses and connect wiring harnesses to electrical components, such as fuses and relays. U.S. Pat. No. 7,594,830 discloses such an electrical junction box with a box body formed by combining upper and lower cases. A circuit board, such as a printed circuit board, is housed inside the box body, and connection terminals project from the circuit board into a receptacle in the box body. Connectors provided at the terminals of wiring harnesses can be inserted into the receptacle and connected to the connection terminals of the circuit board. The electrical junction box also has a vehicle fixing portion for fixing the electrical junction box to a vehicle by being bolted to or engaged with a vehicle body panel, or being taped to wiring harnesses arranged in the vehicle.

The electrical junction box of U.S. Pat. No. 7,594,830 also has connector locks for fixing the connectors in the receptacle to prevent unexpected separation of the connectors.

The receptacle, the connector locks and the vehicle fixing portion of U.S. Pat. No. 7,594,830 all are provided on the upper case. Accordingly, there is the risk of flexural deformation of the upper case if the vehicle fixing portion is subjected to a load due to vibration or the like while the vehicle is traveling or when the electrical junction box is fixed to the vehicle while the connectors are connected. This flexural deformation could influence the connector locks so that the connector locks are released unexpectedly. The receptacle defines an open recess in the upper case. As a result, the vehicle fixing portion can only be formed on a side face of the upper case, thereby restricting the degree of freedom with respect to the shape of the vehicle fixing portion and the vehicle attachment direction.

To address this problem, the vehicle fixing portion could be separate from the receptacle and the connector locks by providing the receptacle and the connector lock on the upper case and providing the vehicle fixing portion on the lower case. However, with this structure, the upper case is fixed to the connectors by the connector locks, and the lower case is fixed to the vehicle by the vehicle fixing portion. Pulling forces on the wiring harnesses of the connectors due to vibration or the like while the vehicle is traveling could cause the upper case fixed to the connectors to displace in a direction of separation from the lower case because the vehicle fixing portion fixes the lower case to the vehicle. As a result, the connectors housed in the receptacle displace in the direction of separation from the lower case, and there is the risk of reduced contact points with the connection terminals of the circuit board. This therefore is not a desirable solution.

The invention was made in view of the above-described circumstances, and an object thereof is to improve the reliability of connection with connectors and improving the degree of freedom of attachment to a vehicle.

SUMMARY OF THE INVENTION

The invention relates to an electrical junction box with a receptacle in which a connector is housed and a connector lock that fixes the connector in the receptacle. The electrical junction box also has a box body formed by combining first and second cases and a vehicle fixing portion that fixes the box body to a vehicle. The receptacle is provided in the first case, and the connector lock and the vehicle fixing portion are provided on the second case.

The connector lock of the electrical junction box is provided on the second case, and therefore the connector is fixed to the second case. The vehicle fixing portion also is provided on the second case, and therefore the connector is fixed to a vehicle via the second case, and is not fixed to the first case. The wiring harness of the connector might be pulled. However, the connector to which the wiring harness is connected is fixed to the second case, thus preventing the first case from being lifted up by forces on the connector, and preventing displacement of the connector relative to a circuit board. As a result, contact points between the connector and a connection terminal of the circuit board remain stable, and the reliability of connection with the connector is good.

The vehicle fixing portion for fixing the box body to a vehicle is not on the case that has the receptacle. Thus, the position where the vehicle fixing portion is formed is not limited to a side face of the case, and the vehicle fixing portion can, for example, be formed on the bottom face of the second case. Accordingly, the degree of freedom is improved with respect to the shape of the vehicle fixing portion, the direction of attachment to a vehicle, and the like.

The connector lock on the second case may project toward the first case, and a latching catch may be provided on an end of the connector lock for latching the connector. The connector lock may extend from outside the first case into the receptacle via an aperture in a side wall of the first case. Accordingly, the receptacle can be formed with better space utilization compared, for example, to a structure in which a through-hole for the insertion of the connector lock is formed in the bottom wall of the first case, and the connector lock is positioned inside the receptacle via the through-hole. Outward flexural deformation of the connector lock is not restricted, and a sufficient amount of flexural deformation can be achieved. Hence, a secure fixing force based on restoring force from the flexural deformation is assured.

The vehicle fixing portion may be on a bottom wall of the second case and on a side opposite to the first case. Therefore the shape of the vehicle fixing portion can be set relatively easily and freely. Furthermore, the electrical junction box can be fixed to a vehicle via the bottom portion, hereby improving the degree of freedom in attachment to a vehicle. The connector is positioned on the side opposite to the vehicle attachment portion. Thus, the connector is separated from members, such as a vehicle body panel, to which the vehicle fixing portion is fixed. This facilitates securing space in the periphery of the connector and also facilitates inserting and removing the connector.

The vehicle fixing portion may be fixed by receiving an attachment portion on the vehicle, and the direction of insertion of the attachment portion into the vehicle fixing portion may be orthogonal to the direction of inserting the connector into the receptacle. Accordingly, the direction of external force exerted on the electrical junction box during insertion/removal of the connector is different from the direction of external force exerted on the electrical junction box during attachment to a vehicle. An external force exerted on the electrical junction box during insertion/removal of the connector is not in a direction to separate the electrical junction box from the vehicle attachment portion. Thus, the electrical junction box is fixed stably to a vehicle.

The connector may be a stacked connector with a plurality of connector housings. Each connector housing may have a plurality of terminal housing cavities aligned in a row. The connector housings may be stacked in a direction orthogonal to the alignment direction of the cavities.

A stacked connector configured by stacking connector housings is often large, and if the wiring harnesses of the stacked connector are pulled, a large amount of tensile force is exerted on the case to which the stacked connector is fixed. However, the stacked connector of the invention is fixed to the second case that is attached to the vehicle. Therefore even if tensile force is exerted from this connector, it is possible to prevent the stacked connector from becoming separated from the second case and the circuit board, and it is possible to secure contact points between the stacked connector and a connection terminal of the circuit board.

The receptacle is provided in the first case, and the vehicle fixing portion and the connector lock are provided in the second case. Accordingly, the connector is not fixed to the case in which the receptacle is formed. Even if the wiring harness of the connector is pulled, the first case will not be pulled by the connector and lifted off the second case. Thus, the connector will not be separated from the circuit board, and a stable connection between the connector and a connection terminal of the circuit board is assured. Also, the vehicle fixing portion is provided on the second case, in which the receptacle is not formed. Thus, the shape of the vehicle fixing portion, the vehicle attachment direction, and the like are set with a high degree of freedom.

DETAILED DESCRIPTION OF THE PREFERRED EMBODIMENTS

Figure 1:
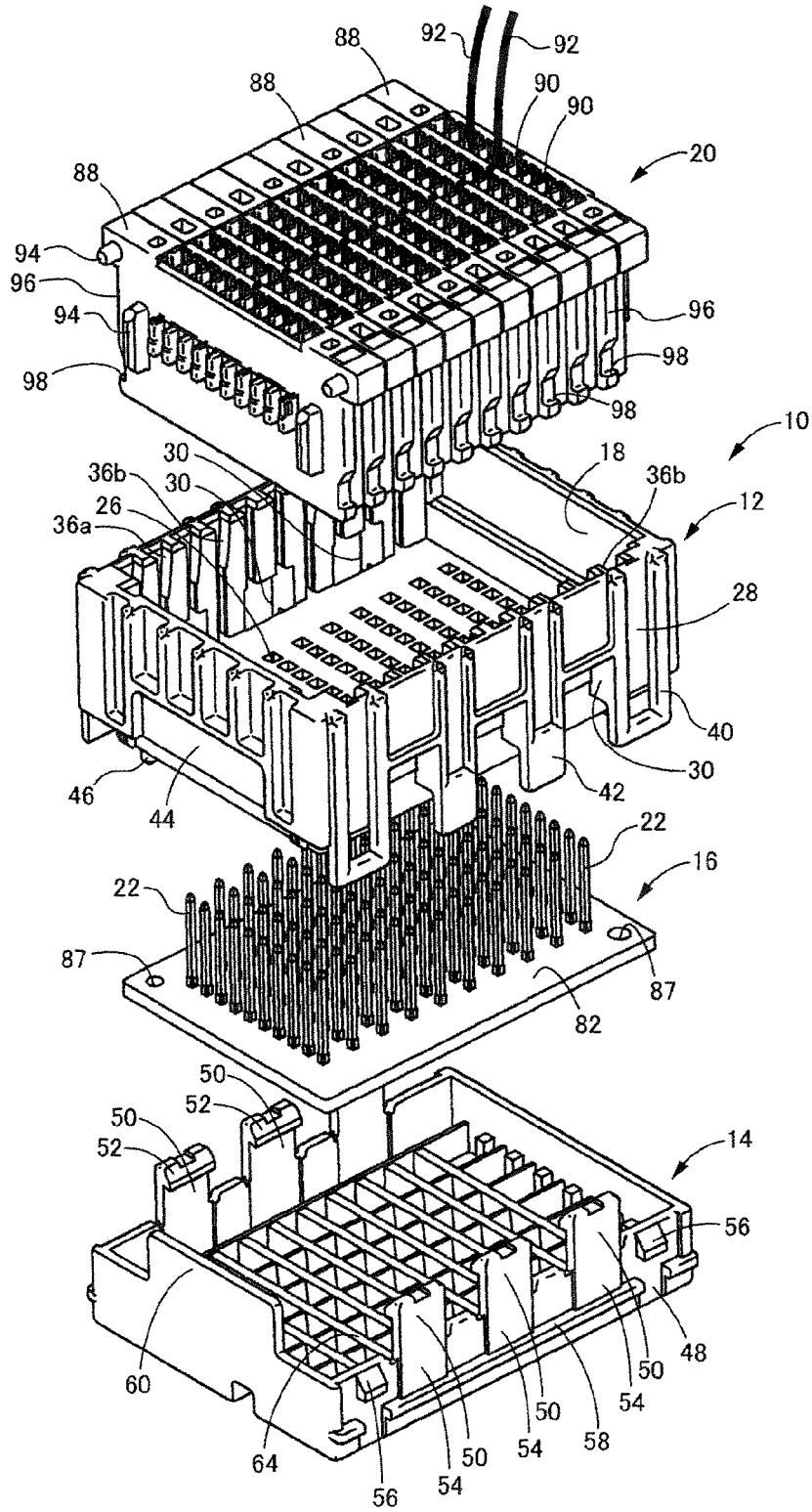
FIG. 1 is an exploded perspective view of an electrical junction box according to a first embodiment of the invention and a stacked connector that can be connected to it.

FIG. 1 shows an electrical junction box 10 according to a first embodiment of the invention. The electrical junction box 10 has a circuit board 16 housed between a first or upper case 12 and a second or lower case 14. A stacked connector 20 is housed in a receptacle 18 in the upper case 12 and can be connected to connection terminals 22 projecting from the circuit board 16. The terms upper and lower are used herein to refer to the orientation shown in FIG. 1.

Figure 2:
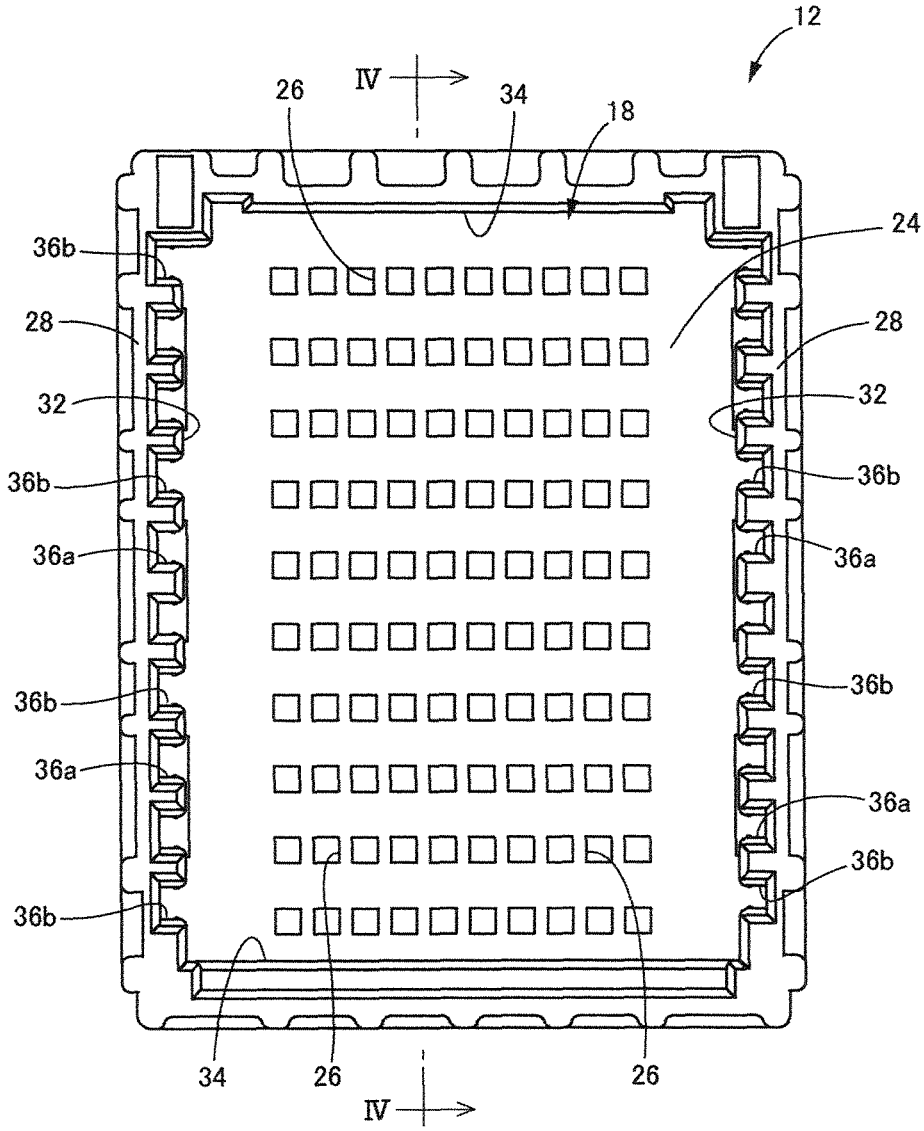
FIG. 2 is a top plan view of the upper case of the electrical junction box of FIG. 1.
Figure 3:
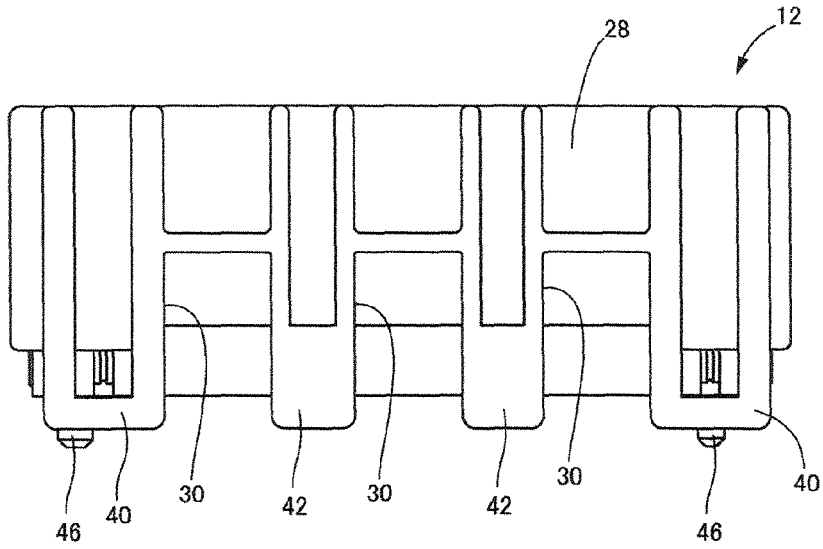
FIG. 3 is a side elevational view of the first case shown in FIG. 2.
Figure 4:
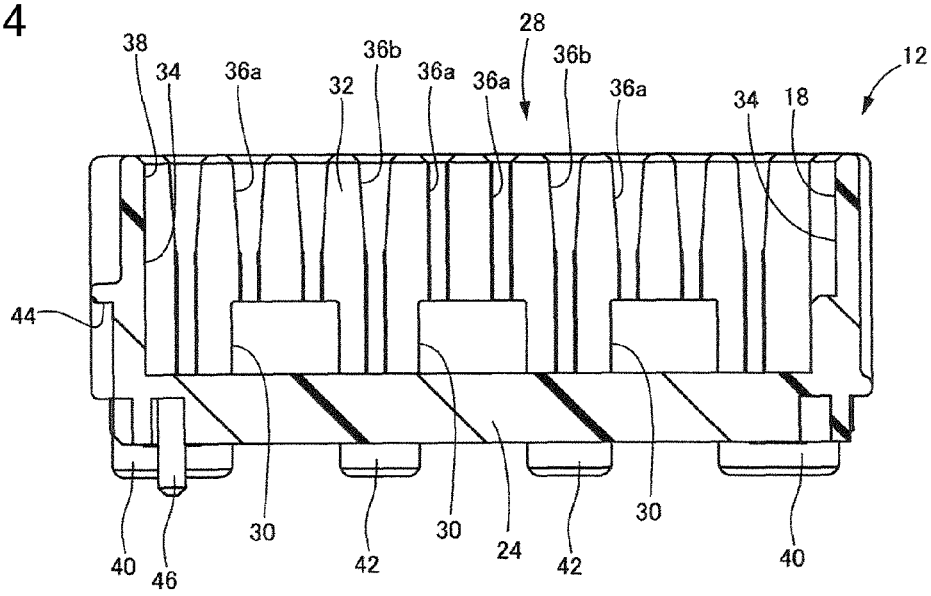
FIG. 4 is a cross-sectional view taken along IV-IV in FIG. 2.

FIGS. 2 to 4 show the upper case 12. The upper case 12 is molded unitarily from synthetic resin to define a substantially elongated rectangular box that is open at the top. The receptacle 18 is a substantially rectangular void in the open top of the upper case 12.

The upper case 12 has a bottom wall 24 at the bottom of the receptacle 18 and terminal insertion holes 26 are formed in the bottom wall 24. In the present embodiment, ten terminal insertion holes 26 are formed in a row and are separated by a constant gap in the short-side direction (left-right direction in FIG. 2) of the receptacle 18, and ten of these rows of terminal insertion holes 26 are formed separated by a constant gap in the long-side direction (up-down direction in FIG. 2) of the receptacle 18.

Side walls 28 extend in the longitudinal direction of the upper case 12 and apertures 30 are formed in a lower half of each side wall 28. The apertures 30 are rectangular through-holes that open in inner faces 32 of the side walls 28. Each aperture 30 corresponds to two rows of the terminal insertion holes 26 and two connector housings 88 of the stacked connector 20, as described below.

The apertures 30 in one of the side walls 28 align respectively with the apertures 30 in the other side wall 28 in the longitudinal direction of the upper case 12, and the apertures in each side wall 28 are separated from one another by gaps in the longitudinal direction of the upper case 12. In the present embodiment, three apertures 30 are formed in each side wall 28 so that a gap corresponding to one row of the terminal insertion holes 26 separates adjacent apertures 30 from each other and separates the apertures 30 from opposite longitudinal ends 34 of the receptacle 18.

Guiding grooves 36*a* and 36*b* are formed in the inner faces 32 of the receptacle 18, as shown in FIGS. 2 and 4, and extend in the up-down direction with a constant depth dimension in the left-right direction in FIG. 2. One end of each guiding groove 36*a*, 36*b* is open to a top opening 38 of the receptacle 18. The guiding grooves 36*a* and 36*b* are separated from one another by constant gaps in the longitudinal direction of the receptacle 18, with the gaps corresponding to the rows of terminal insertion holes 26 and to connector housings 88 of the stacked connector 20 described below. In the present embodiment, ten guiding grooves 36*a* and 36*b* are formed in each of the inner faces 32. Each guiding groove 36*a* overlaps an aperture 30 and extends from the aperture 30 to the top opening 38 of the receptacle 18 in the up-down direction, which is the insertion/removal direction of the stacked connector 20. On the other hand, each guiding groove 36*b* is formed between adjacent aperture holes 30 or between an aperture hole 30 and an end 34 of the receptacle 18, and is formed over the entire length of the inner face 32 in the up-down direction. The guiding grooves 36*a* and 36*b* other than the two guiding grooves 36*a* in the center in the longitudinal direction of the receptacle 18 have width dimensions (left-right dimension in FIG. 4) that increase slightly toward the top opening 38 to achieve a tapered entry for facilitating the insertion of the connector housings 88.

Two engaging frames 40 are formed on the outer side of each side wall 28 of the upper case 12, as shown in FIG. 3. The engaging frames 40 are at end portions of the side walls 28 in the longitudinal direction of the upper case 12 and project from the side walls 28 toward the lower case 14. Positioning projections 42 also are formed on the outer sides of the side walls 28. The positioning projections 42 are plates that project toward the lower case 14 from positions between the apertures 30 in the side walls 28. The engaging frames 40 and the positioning projections 42 have substantially equal projecting lengths.

As shown in FIG. 4, a positioning recess 44 is formed in one of the outer sides of the upper case 12 in the longitudinal direction. Furthermore, positioning bosses 46 are formed in each of two diagonally opposite corners of the bottom wall 24 of the upper case 12 and project toward the lower case 14.

Figure 5:
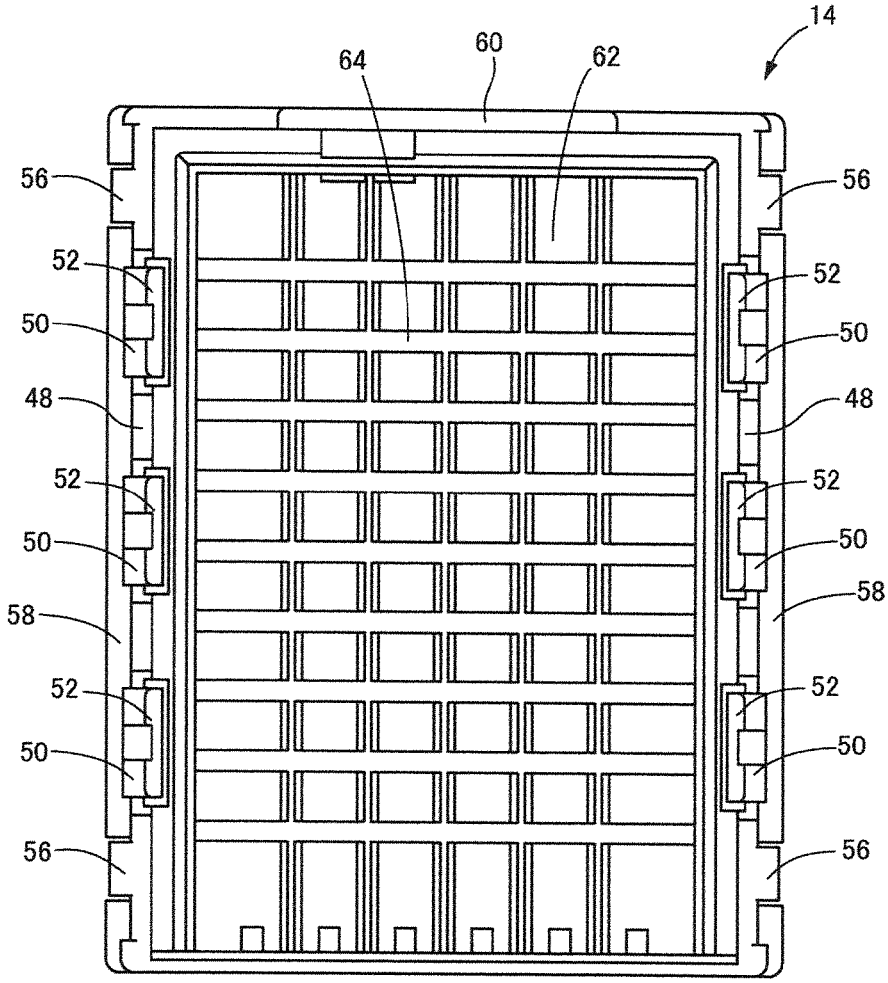
FIG. 5 is a top plan view of the lower case of the electrical junction box of FIG. 1.
Figure 6:
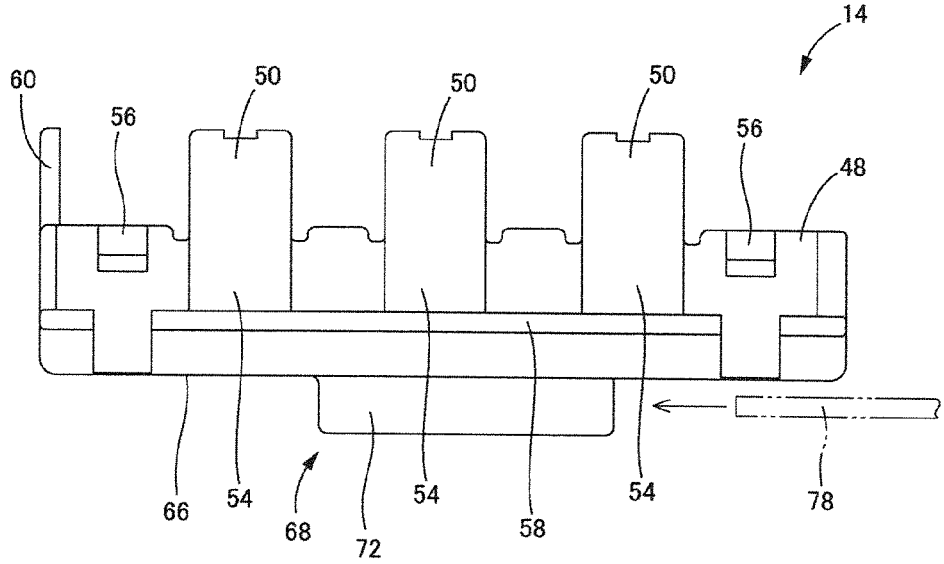
FIG. 6 is a front elevational view of the lower case of FIG. 5.
Figure 7:
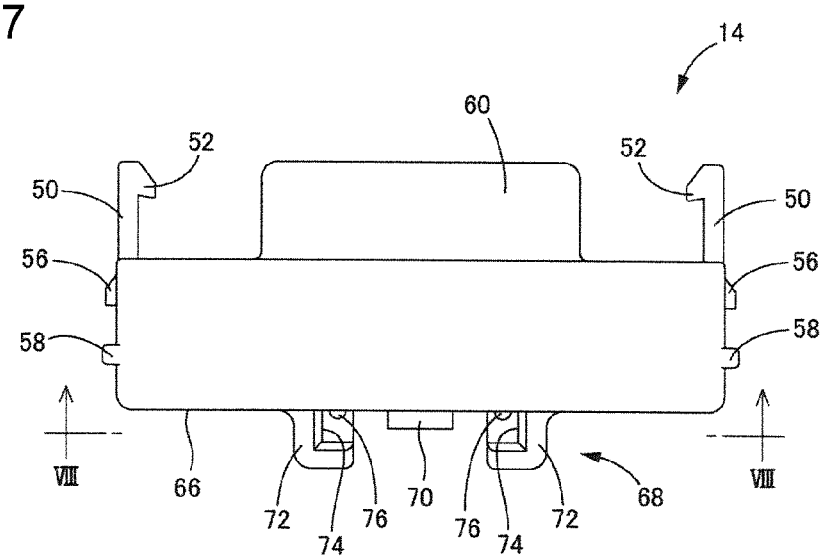
FIG. 7 is a side elevational view of the lower case of FIG. 5.

FIGS. 5 to 7 show the lower case 14. The lower case 14 is molded unitarily from synthetic resin to define a substantially elongated rectangular box body that is open toward upper case 12. The lower case 14 has side walls 48 that extend in the longitudinal direction and connector locks 50 project from the side walls 48 toward the upper case 12. A latching catch 52 is formed on the end of each of the connector lock 50 and projects toward the interior of the lower case 14. Each connector lock 50 has a width (left-right dimension in FIG. 6) that is slightly smaller than the width of each aperture 30 of the upper case 12 so that the latching catches 52 can be inserted into the apertures 30. Accordingly, the connector locks 50 of the present embodiment have a width dimension corresponding to two of the connector housings 88 of the stacked connector 20. The connector locks 50 are at positions corresponding to the apertures 30. Thus, in the present embodiment, three connector locks 50 are formed in each side wall 48, and are separated by a gap corresponding to one connector housing 88 in the longitudinal direction of the lower case 14. Note that lower ends 54 of the connector locks 50 extend up beyond the side walls 48, and jut out slightly from the outer sides of the side walls.

Two engaging protrusions 56 project out from upper portions of each side wall 28 at positions near the longitudinal ends of the respective side wall 48. Furthermore, a positioning rib 58 projects out from the vertically central portion of each side wall 48 and extends over substantially the entire length of the side wall 48 in the longitudinal direction (left-right direction in FIG. 6). Accordingly, the lower ends 54 of the connector locks 50 are joined to the positioning ribs 58.

A positioning wall 60 is formed on one longitudinal end of the lower case 14 and projects toward the upper case 12. Moreover, the lower case 14 has a bottom wall 62 and lattice-shaped support ribs 64 are formed on the inner face of bottom wall 62 to project toward the upper case 12. The support ribs 64 support the circuit board 16.

Figure 8:
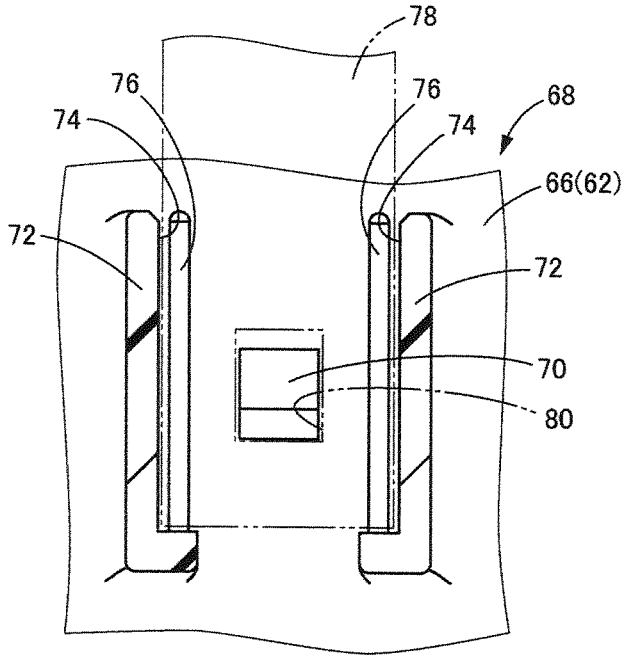
FIG. 8 is an enlarged cross-sectional view taken along VIII-VIII in FIG. 7.

A vehicle fixing portion 68 is formed on an outer face 66 of the bottom wall 62 for fixing the electrical junction box 10 to a vehicle. The vehicle fixing portion 68 can have one of many conventionally-known shapes. As shown in FIG. 8, a locking catch 70 projects out from the outer face 66 in the vehicle fixing portion 68 of the present embodiment, and guides 72 sandwich the locking catch 70. Each guide 72 has an L-shaped cross-section and extends in the longitudinal direction (left-right direction in FIG. 6) of the bottom wall 62. An insertion opening 74 is formed in each guide 72 opens at one side in the extending direction (upward in FIG. 8, and rightward in FIG. 6). Clamping ribs 76 project out from the outer face 66 at positions inward of the guides 72 and extend along the guide 72. A bracket 78 on a body panel or the like of a vehicle can be inserted into the insertion openings 74 of the guides 72 and can be guided in the longitudinal direction of the bottom wall 62 while being sandwiched by the guides 72 and the clamping ribs 76. The locking catch 70 then enters and engages an engaging hole 80 in the bracket 78 to attach the lower case 14 to the vehicle.

The circuit board 16 of FIG. 1 is housed between the upper and lower cases 12 and 14. The circuit board 16 of this embodiment is a conventionally-known printed wiring board, and connection terminals 22 are fixed by soldering, press fitting, or the like to project out from through-holes in a printed circuit board 82 on which printed wiring (not shown) is arranged. The connection terminals 22 define a 10×10 array corresponding to the terminal insertion holes 26 of the upper case 12. The circuit board 16 need not be a printed circuit board, and can be any of various types of boards conventionally used to configure circuits in electrical junction boxes, such as a bus bar formed from a metal plate.

Figure 9:
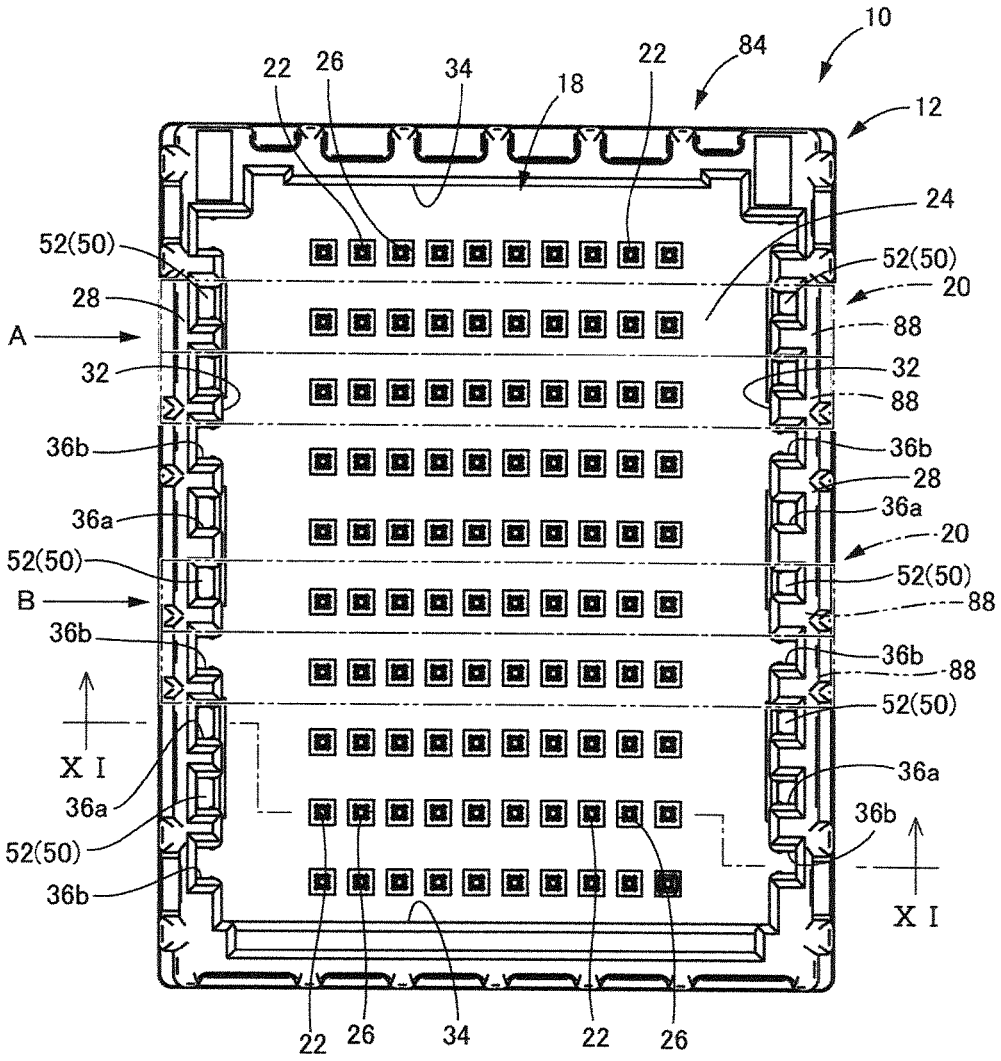
FIG. 9 is a top plan view of the electrical junction box of FIG. 1.
Figure 10:
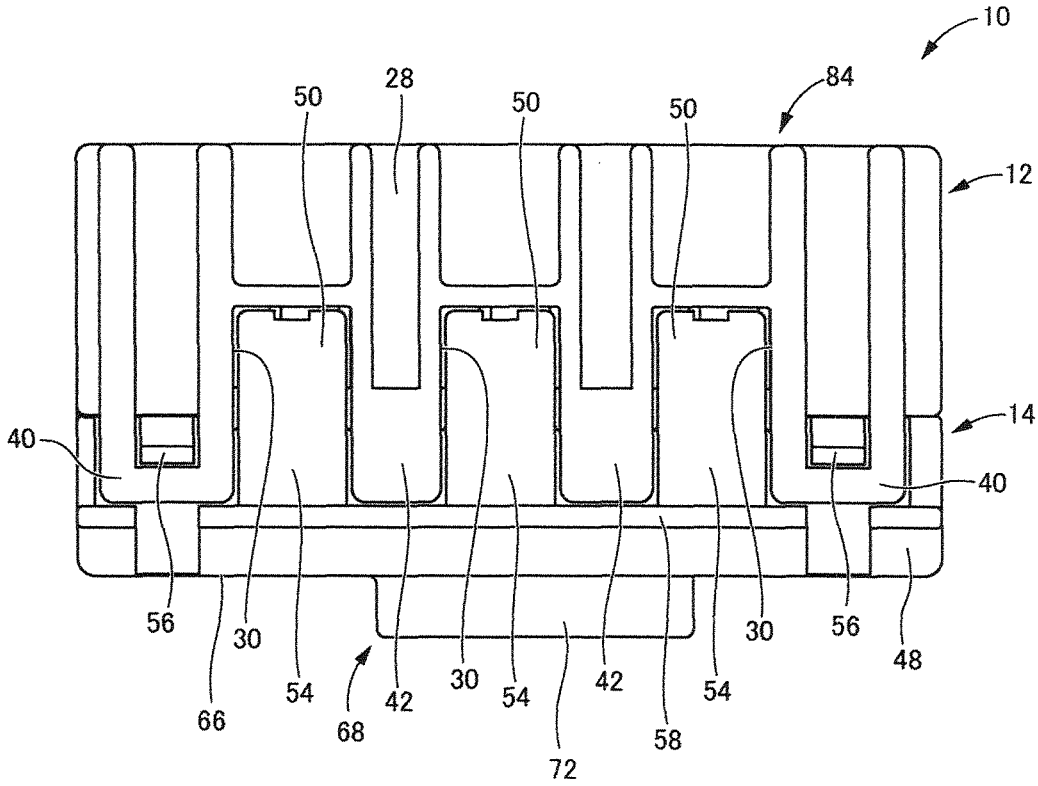
FIG. 10 is a front elevational view of the electrical junction box of FIG. 9.
Figure 11:
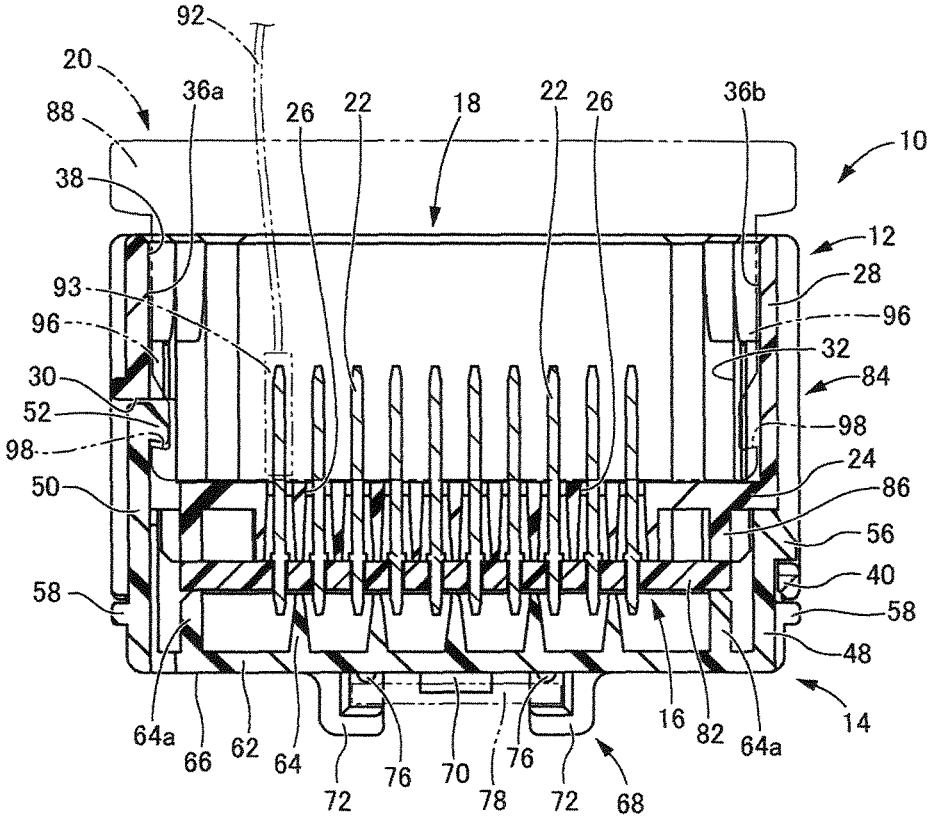
FIG. 11 is a cross-sectional view along XI-XI in FIG. 9.

The upper case 12 is placed over the lower case 14 with the circuit board 16 therebetween, and the engaging frames 40 of the upper case 12 engage with the engaging protrusions 56 of the lower case 14. As shown in FIGS. 9 to 11, the upper and lower cases 12 and 14 are assembled to form a box body 84. The positioning wall 60 of the lower case 14 is fit into the positioning recession 44 (see FIG. 1) of the upper case 12, and the positioning projections 42 of the upper case 12 are fit between the connector locks 50 of the lower case 14 to position the upper and lower cases 12 and 14 horizontally with respect to each other in directions (up-down and left-right directions in FIG. 9) orthogonal to the assembling direction. Additionally, the engaging frames 40 and the positioning projections 42 of the upper case 12 contact the positioning ribs 58 of the lower case 14, and the bottom wall 24 of the upper case 12 contacts the side walls 48 of the lower case 14, as shown in FIG. 11, to position the upper and lower cases 12 and 14 in the assembling direction (up-down direction in FIG. 11).

As shown in FIG. 11, lattice-shaped support ribs 86 are formed on the outer face of the bottom wall 24 of the upper case 12 to sandwich the printed circuit board 82 between the support ribs 86 of the upper case 12 and the support ribs 64 of the lower case 14. Support ribs 64*a* at the outer periphery of the lower case 14 project slightly more than the inward support ribs 64. Accordingly, the outer peripheral portion of the printed circuit board 82 where printed wiring is not formed is clamped with higher contact pressure. In this way, the circuit board 16 is housed inside the box body 84 so that the printed circuit board 82 is sandwiched between the upper and lower cases 12 and 14 without being fixed to the upper or lower cases 12 or 14. Also, as shown in FIG. 1, through-holes 87 are formed in diagonally opposite corners of the printed circuit board 82, and the circuit board 16 is positioned with respect to the upper case 12 by inserting the positioning bosses 46 of the upper case 12 into the through-holes 87. The connection terminals 22 of the circuit board 16 are inserted into the terminal insertion holes 26 of the upper case 12 and project into the receptacle 18.

The latching catches 52 of the connector locks 50 on the lower case 14 are inserted from outside the upper case 12 into the corresponding apertures 30 in the upper case 12, and project from outside the upper case 12 through the apertures 30 and into the receptacle 18 when the upper and lower cases 12 and 14 are assembled.

The stacked connector 20 shown in FIG. 1 may be a conventionally known connector, such as those shown in JP 2008-131843A, JP 2004-335218A, or the like, and is connected to the electrical junction box 10. The stacked connector 20 will only be described briefly since it is known in the prior art.

The stacked connector 20 has multiple stacked housings 88. The housings 88 all have the same shape and are synthetic resin members with a linear array of terminal cavities 90 (ten in the present embodiment to correspond to the number of terminal insertion holes 26 in one row). The terminal cavities 90 can house connection terminals 93 (e.g., crimp-style terminals) provided at ends of wiring harnesses 92, as shown schematically in FIG. 11. The connection terminals 93 are housed individually in the terminal cavities 90 of the connector housings 88, and the wiring harnesses 92 extend from the connection terminals 93 to the outside of the connector housing 88. However, only some of the wiring harnesses 92 and the connection terminals 93 are shown in FIGS. 1 and 11. Engaging projections 94 are formed on one face of each connector housing 88, and engaging recesses are formed on the opposite face (not shown) at positions corresponding to the engaging projection portions 94. Multiple connector housings 88 then are stacked in the direction orthogonal to the alignment direction of the terminal cavities 90, and the stacked state is maintained by the engaging projects 94 of one connector housing 88 engaging with the engaging recesses of another connector housing 88. Accordingly, the number of connector poles can be adjusted by adjusting the number of connector housings 88 that are stacked.

Guiding ribs 96 that project outward in the width direction and extend in the direction of insertion into the connector housing portion 18 are respectively formed at the two end edge portions of each connector housing 88 in the width direction. An engaging notch 98 is formed in the lower end portion (end portion at the front in the direction of insertion into the connector housing portion 18) of each guiding rib 96.

The stacked connector 20 having the above-described structure is inserted into the receptacle 18 of the electrical junction box 10. The guiding ribs 96 of the connector housings 88 are inserted into the guiding grooves 36*a* and 36*b* of the receptacle 18 to guide the stacked connector 20 in the insertion/removal direction. As shown in FIG. 11, the latching catches 52 of the connector locks 50 engage the engaging notches 98 on the guiding ribs 96 of the connector housings 88 when the stacked connector 20 is pressed into the receptacle 18 for fixing the stacked connector 20 in the receptacle 18. In the present embodiment, the latching catch 52 of each connector lock 50 engages with the engaging notches 98 of two connector housings 88 that are successive in the stacking direction. In this way, the connection terminals 93 in the connector housings 88 are connected to the connection terminals 22 of the circuit board 16. As a result, the wiring harnesses 92 connected to the stacked connector 20 are branch-connected with respect to each other via printed wiring (not shown) of the circuit board 16. As described above, the vehicle fixing portion 68 of the lower case 14 of the electrical junction box 10 is then fixed to the bracket 78 of a vehicle for fixing the box body 84 to the vehicle.

The connector locks 50 are formed on the lower case 14. Accordingly, the shape of the connector locks 50 is not restricted by the shape of the receptacle 18 of the upper case 12, and can be set with a high degree of freedom in design. As a result, the connector locks 50 are not limited to the interior of the guiding grooves 36*a* and 36*b* of the receptacle 18, and can be large enough to span multiple guiding grooves 36*a* and 36*b*. In the present embodiment, one connector lock 50 is large enough to span two connector housings 88. Accordingly, each connector lock 50 engages with multiple connector housings 88, thus making it possible to secure a greater area of contact with the stacked connector 20 and obtain more stable fixing force.

The connector locks 50 are provided on the lower case 14 and the stacked connector 20 is fixed to the lower case 14 instead of being fixed to the upper case 12 in which the receptacle 18 is formed. The wiring harnesses 92 might be pulled. However, a tensile force applied to the wiring harness 92 will not be transmitted to the upper case 12, thus preventing the upper case 12 from lifting off the lower case 14. As a result, the stacked connector 20 will not be lifted from the bottom wall 24 of the upper case 12 and become displaced relative to the circuit board 16, thus enabling stable contact points between the stacked connector 20 and the connection terminals 22 of the circuit board 16.

The vehicle fixing portion 68 for attaching the electrical junction box 10 to a vehicle is on the lower case 14, and can be on a side face of the lower case 14 or on the bottom wall 62, as in the present embodiment. This improves the design freedom of the vehicle fixing portion 68, and enables a higher degree of freedom in setting the vehicle attachment structure, attachment direction, and the like. In the present embodiment, the direction of insertion of the bracket 78 of a vehicle into the vehicle fixing portion 68 is orthogonal to the insertion/removal direction of the stacked connector 20, thus reducing the risk of the electrical junction box 10 separating from the bracket 78 of the vehicle due to external force for inserting/removing the stacked connector 20. Also, the opening 38 of the receptacle 18 faces away from the bracket 78 of the vehicle, thereby more easily securing space in the periphery of the opening 38 and facilitating inserting/removing the stacked connector 20.

The latching catches 52 of the connector locks 50 pass through the apertures 30 of the upper case 12 from outside the upper case 12 to the interior of the receptacle 18. Accordingly, the receptacle 18 has better space utilization compared to a structure in which through-holes are formed in the bottom wall 24 of the upper case 12, and the connector locks 50 are inserted from below. Furthermore, since the connector locks 50 are positioned the farthest outward with respect to the junction box 10, and the amount of outward flexure deformation is not restricted, it is possible to secure a stable fixing force of the stacked connector 20 based on the restoring force of the flexure deformation.

The apertures 30 that receive the connector locks 50 are formed in a lower part of the side walls 28 of the upper case 12. Accordingly, guiding grooves 36*a* and 36*b* can be formed so as to correspond with all of the connector housings 88 in the upper half of the side walls 28. As a result, regardless of how many connector housings 88 are stacked, and regardless of where the stacked connector 20 is inserted, the guiding grooves 36*a* and 36*b* guide all of the connector housings 88 stably in the insertion/removal direction.

The connector locks 50 are separated by a gap corresponding to one connector housing 88 and one guiding groove 36*a* or 36*b*. Therefore a stacked connector 20 that has at least two stacked connector housings 88 can be fixed by connector locks 50 regardless of where the stacked connector 20 is inserted, such as in portion A or portion B shown in FIG. 9. Accordingly, there is no need to stack extra housings to engage the locks when few connector housings are needed, as in the case of conventional structures, thus reducing the number of components. Furthermore, the connector locks 50 are separated by gaps. The guiding grooves 36*b* between adjacent connector locks 50 and between the connector locks 50 and the ends 34 of the receptacle 18 are formed on the side walls 28 over the entire length from the opening top 38 to the bottom wall 24 in the insertion/removal direction of the stacked connector 20. Thus, the connector housings 88 of the stacked connector 20 are guided very stably when inserted into the guiding grooves 36*b*.

Figure 12:
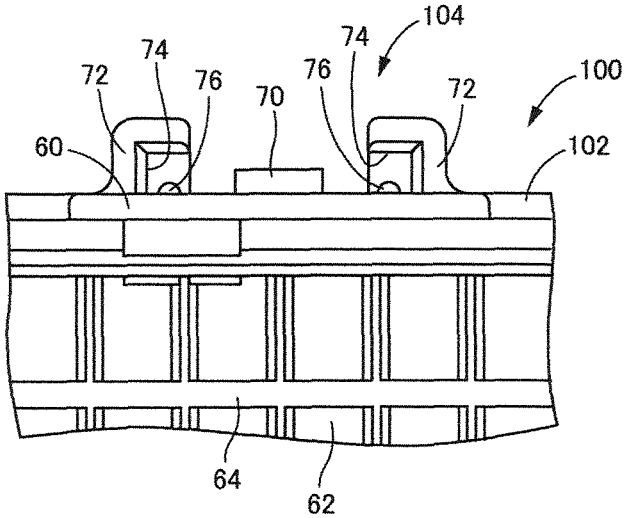
FIG. 12 is a top plan view of main portions of a lower case of an electrical junction box according to a second embodiment of the invention.
Figure 13:
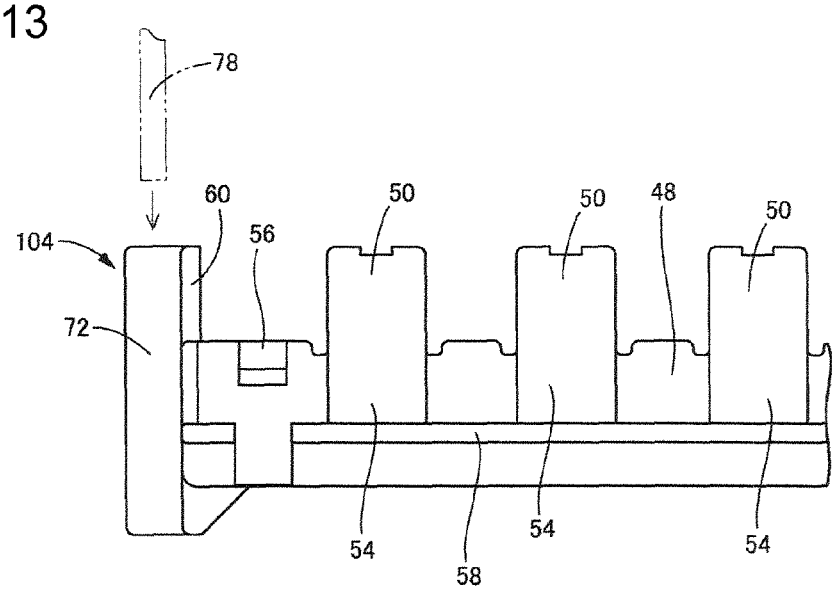
FIG. 13 is a side elevational view of the lower case shown in FIG. 12.

FIGS. 12 and 13 show main portions of a lower case 100 of an electrical junction box of a second embodiment of the invention. Note that the same reference signs as those in the first embodiment have been given to members and sites in the drawings whose structures are similar to those in the first embodiment, and descriptions thereof have been omitted.

The lower case 100 of the second embodiment has a side wall 102 and a vehicle fixing portion 104 is on the side wall 102 at one longitudinal end of the lower case 100. The vehicle fixing portion 104 is similar to the vehicle fixing portion in the first embodiment. More particularly, the guides 72 extend in the up-down direction in FIG. 13), and the insertion openings 74 of the guides 72 open up in FIG. 13. In this way, the vehicle fixing portion can be formed on a side wall of the lower case rather than the bottom wall.

Figure 14:
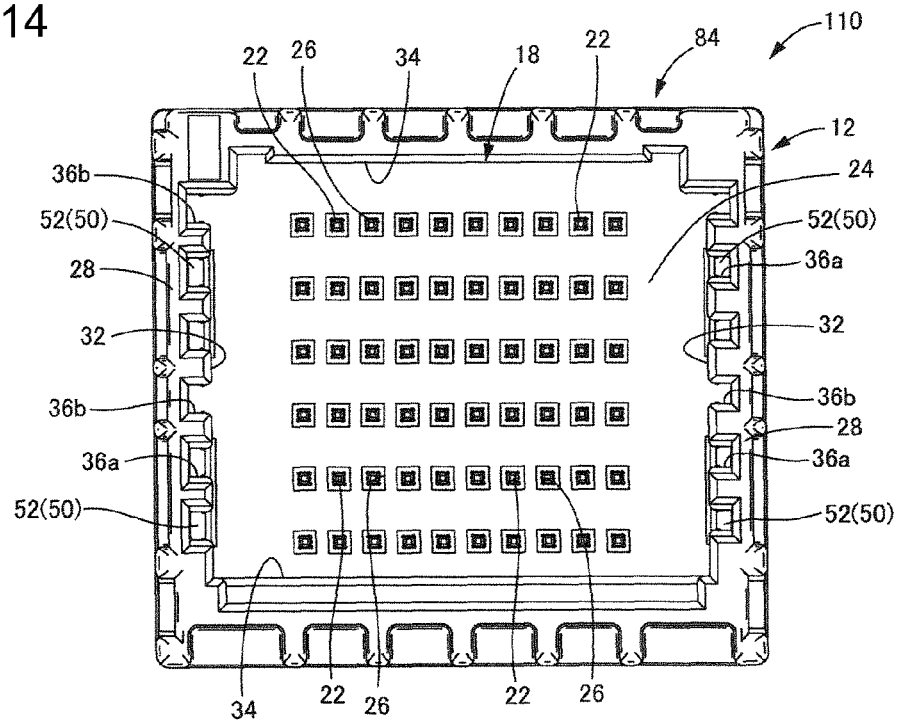
FIG. 14 is a plan view of an electrical junction box according to a third embodiment of the present invention.

FIG. 14 shows an electrical junction box 110 according to a third embodiment of the invention. Fewer connector housings 88 can be housed in the receptacle 18 of the electrical junction box 110 compared to the electrical junction box 10 of the first embodiment, and specifically a maximum of six connector housings 88 can be housed. In this way, the maximum number of connector housings 88 that are housed in the receptacle 18 can be set according to needs. Note that in the present embodiment, two connector locks 50 are formed in the stacking direction of the connector housings 88, and these connector locks 50 are separated by a gap corresponding to one connector housing 88, similar to the embodiments described above. Also, one of the connector locks 50 is separated from an end edge 34 of the receptacle 18 by a gap corresponding to one connector housing 88. Accordingly, in the present embodiment as well, as long as at least two connector housings 88 are stacked, the stacked connector 20 can be fixed with the connector locks 50 regardless of the position in which it is inserted.

Although embodiments of the invention have been described in detail above, the invention is not limited to those specific descriptions. For example, the specific shape of the connector locks is not limited to the shapes described in the above embodiments, and the connector locks may be large enough to engage with three or more connector housings, for example. Also, through-holes may be formed in the bottom wall 24 of the upper case 12 in the above embodiments, and the connector locks 50 are positioned in the receptacle 18 by being inserted into the through-holes from below.

Also, although a stacked connector configured by combining connector housings is given as an example of the connector in the above embodiments, the present invention is also applicable to an electrical junction box for connection with a general connector configured from a single member.

Also, the present invention can be applied to various types of electrical junction boxes, such as an electrical junction box that internally includes a control board such as an ECU, and an electrical junction box to which connectors and other electrical components such as fuses and relays are connected.

What is claimed is:

1. An electrical junction box comprising:

a receptaclein which a connector is housed;

a connector lock that fixes the connector in the receptacle; and a vehicle fixing portion that fixes a box body to a vehicle, wherein the box body is formed by combining first and second cases, the receptacle is provided in the first case, and the connector lock and the vehicle fixing portion are provided on the second case.

2. The electrical junction box of claim 1, wherein the connector lock on the second case projects toward the first case, and a latching catch that latches the connector is provided on an end of the connector lock and is positioned to extend from outside the first case into the receptacle via an aperture provided in a side wall of the first case.

3. The electrical junction box of claim 1, wherein the vehicle fixing portion is on a bottom wall of the second case on a side opposite to the first case.

4. The electrical junction box of claim 1, wherein the vehicle fixing portion is fixed by receiving an attachment portion on the vehicle, and a direction of insertion of the attachment portion into the vehicle fixing portion is orthogonal to a direction of insertion of the connector into the receptacle.

5. The electrical junction box of claim 1, wherein the connector is a stacked connector with a plurality of connector housings, each obtained by forming a plurality of terminal cavities aligned in a row, are stacked in a direction orthogonal to the alignment direction of the plurality of terminal cavities.

6. An electrical junction box comprising:

a first case having a bottom wall and side walls extending from the bottom wall to define a receptacle, apertures formed in the first case and communicating with the receptacle;

a connector disposed in the receptacle;

a circuit component facing a side of the bottom wall opposite the receptacle;

a second case sandwiching the circuit component between the first and second cases, locks projecting from the second case and passing through the apertures in the first case, the locks engaging the connector and holding the connector in the receptacle, a vehicle fixing portion formed on the second case and configured for fixing the electrical junction box to a vehicle.

7. The electrical junction box of claim 6, wherein the vehicle fixing portion is on a bottom wall of the second case on a side opposite to the first case.

8. The electrical junction box of claim 7, wherein the vehicle fixing portion is fixed by receiving an attachment portion on the vehicle, and a direction of insertion of the attachment portion into the vehicle fixing portion is orthogonal to a direction of insertion of the connector into the receptacle.

9. The electrical junction box of claim 6, wherein the vehicle fixing portion is on a side wall of the second case aligned substantially parallel to a projecting direction of the locksfrom the second case.

10. The electrical junction box of claim 9, wherein the vehicle fixing portion is fixed by receiving an attachment portion on the vehicle, and a direction of insertion of the attachment portion into the vehicle fixing portion is parallel to a direction of insertion of the connector into the receptacle.

* * * * *